US010307930B2

(12) United States Patent
Fuchs et al.

(10) Patent No.: US 10,307,930 B2
(45) Date of Patent: Jun. 4, 2019

(54) GUIDE BAR FOR A SAW CHAIN HAVING A REDUCED-WEAR DIRECTION-REVERSING SECTION

(71) Applicant: Andreas Stihl AG & Co. KG, Waiblingen (DE)

(72) Inventors: Alexander Fuchs, Bietigheim-Bissingen (DE); Thomas Voigt, Winterbach (DE); David Mitrega, Winnenden (DE); Matthias Schulz, Freiberg am Neckar (DE); Thomas Lux, Welzheim (DE); Oliver Gerstenberger, Ditzingen (DE); Jochen Buchholtz, Waiblingen (DE); Berthold Schell, Backnang (DE); Norbert Apfel, Waiblingen (DE); Bernd Hein, Esslingen (DE); Ruediger Ludwig, Backnang (DE); Jan Foehrenbach, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 14/465,411

(22) Filed: Aug. 21, 2014

(65) Prior Publication Data

US 2015/0052762 A1 Feb. 26, 2015

(30) Foreign Application Priority Data

Aug. 21, 2013 (DE) ..... 10 2013 013 956

(51) Int. Cl.
*B27B 17/02* (2006.01)

(52) U.S. Cl.
CPC ..... *B27B 17/025* (2013.01)

(58) Field of Classification Search
CPC ..... B27B 17/02
See application file for complete search history.

(56) References Cited

U.S. PATENT DOCUMENTS 2,811,342 A * 10/1957 McCallum ..... B27B 17/025 299/82.1
4,381,606 A * 5/1983 Ekrud ..... B27B 17/025 30/387

(Continued)

FOREIGN PATENT DOCUMENTS

CN 201168985 Y 12/2008
CN 202922691 U 5/2013
DE 4318492 A1 12/1994

*Primary Examiner* — Kenneth E Peterson
*Assistant Examiner* — Liang Dong
(74) *Attorney, Agent, or Firm* — Walter Ottesen, P.A.

(57) ABSTRACT

A guide bar for a saw chain includes an elongate, flat base body made of a basic material. The base body extends along a longitudinal center axis and, in order to guide a saw chain, has a running surface formed on an outer periphery thereof and a guide groove formed in the outer periphery of the base body. The guide groove has a groove base. A direction-reversing section for the saw chain is provided at one end of the base body. The direction-reversing section includes at least one add-on component having a running surface made of more wear-resistant material than the basic material of the base body. The add-on component is secured to the base body of the guide bar by at least one weld seam. The weld seam extends between the add-on component and the base body and is located spatially beneath the groove base.

22 Claims, 6 Drawing Sheets

(56) References Cited

U.S. PATENT DOCUMENTS

| | | | | | |
|---|---|---|---|---|---|
| 4,489,493 | A | | 12/1984 | Tsumura | |
| 4,651,424 | A | * | 3/1987 | Yamada | B27B 17/025 30/383 |
| 5,564,192 | A | | 10/1996 | Wilhelm et al. | |
| 5,603,311 | A | * | 2/1997 | Hoerner | B27B 17/02 125/21 |
| 5,682,680 | A | * | 11/1997 | Haussermann | B27B 17/025 30/383 |
| 2008/0178478 | A1 | * | 7/2008 | Chang | B27B 17/025 30/383 |
| 2012/0279074 | A1 | * | 11/2012 | Ruth | B27B 17/025 30/383 |

* cited by examiner

GUIDE BAR FOR A SAW CHAIN HAVING A REDUCED-WEAR DIRECTION-REVERSING SECTION

CROSS REFERENCE TO RELATED APPLICATION

This application claims priority of German patent application no. 10 2013 013 956.2, filed Aug. 21, 2013, the entire content of which is incorporated herein by reference.

BACKGROUND OF THE INVENTION

A known guide bar includes an elongate, flat base body made of a base body material. The base body extends along a longitudinal center axis and, in order to guide a saw chain, has a running surface formed on an outer periphery of the base body and a guide groove formed in the outer periphery of the base body. The guide groove has a groove base. Formed at one end of the base body is a direction-reversing section for the saw chain, wherein the direction-reversing section includes at least one add-on component having a running surface made of more wear-resistant material than the basic material of the base body. The add-on component is secured to the base body of the guide bar by at least one weld seam.

The connection of the add-on component made of wear-resistant material to the base body material of the base body can result in high local stress peaks in the base body material or in the weld seam, and this can result in damage when the guide bar is subjected to mechanical loads.

SUMMARY OF THE INVENTION

It is an object of the invention to provide a guide bar of the generic type such that, while the guide bar has a simple structure, a firm, durable connection between the add-on component and the guide bar is established without excessive material stresses occurring as a result of the welding operation.

The guide bar of the invention is for a saw chain. The guide bar defines a longitudinal center axis and includes: an elongated, flat base body made of a base body material and extending along the longitudinal center axis; the base body having an outer periphery and having a guide track formed on the outer periphery for the saw chain; the guide track including a guide groove configured in the periphery and the guide groove having a groove base; a direction-reversing section for the saw chain configured on one end of the base body; the material of the base body being a wear-resistant material; the direction-reversing section being configured as an add-on component made of a material having a wear resistance greater than the wear resistance of the base body material; and, the add-on component being fixed to the base body by a weld seam having a length (S) and running between the add-on component and the base body and arranged to lie spatially below the groove base of the guide groove over a major part of the length (S).

The weld seam extends between the add-on component and the base body in the front region of the guide bar and is located—at least over a major part of its length—spatially beneath the groove base of the guide groove for guiding the saw chain. The weld seam is at a distance, measured in the plane of the guide bar, from the running surface of the guide bar of less than about 1.5 times to 3 times the depth of the guide groove. As a result of the weld seam being moved—as seen in the viewing direction toward the open guide groove or the groove base—to under the groove base of the guide groove, the material stress in the region of the groove base can be significantly lowered. This ensures that the add-on component is secured permanently to the base body of the guide bar and also resists high mechanical operating loads.

According to a feature of the invention, a segment of the guide groove is formed together with the groove base in the add-on component, such that an even larger spatial distance can be established between the weld seam and the groove base.

Advantageously, the main body of the guide bar engages over the add-on component such that the base body overlaps the add-on component. The weld seam is in this case arranged such that it forms an outer boundary of the overlap region, that is, is located in the edge region of the overlap region.

Expediently, the add-on component is fixed in its position on the base body. Advantageously, to this end, a finger-like, flat projection is formed on each flat side of the base body and this projection extends in the direction of the longitudinal center axis of the base body and forms the end of the base body. The add-on component is fixed in its position on the base body by the projections.

According to another feature of the invention, a recessed region for accommodating the projection, which is formed in particular in a flat manner, is provided in the outer side of an add-on component, such that the add-on component is located in an oriented manner in the plane of the guide bar. Expediently, for precise position fixing, the projection engages in the recessed region of the add-on component largely without play.

If the add-on component is formed with a slight excess thickness with respect to the distance between the projections, the add-on component—even when it consists of a plurality of add-on component halves—can be kept clamped between the projections. This is advantageous during pre-assembly in the manufacture of the guide bar.

The weld seam is guided such that it extends, at least along a segment of its length, along a longitudinal edge of the projection.

The add-on component preferably consists of a sintered material, in particular of Stellite®. In particular a cobalt-base alloy with 29 percent by weight of chromium, 8 percent by weight of tungsten and 1.3 percent by weight of carbon is advantageous as the material.

Expediently, the add-on component is composed of two add-on component halves which abut one another at a partition plane. If the add-on component halves are formed as identical parts, the add-on component halves are easy to manufacture and assemble.

The base body of a guide bar has two flat sides, wherein a weld seam is formed on each flat side of the base body in order to connect the add-on component non-detachably to the base body. According to another feature of the invention, the add-on component can have a partition plane, wherein the weld seams arranged on each flat side merge into one another in the region of the partition plane and ensure an intimate connection also of the add-on component halves of the add-on component.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
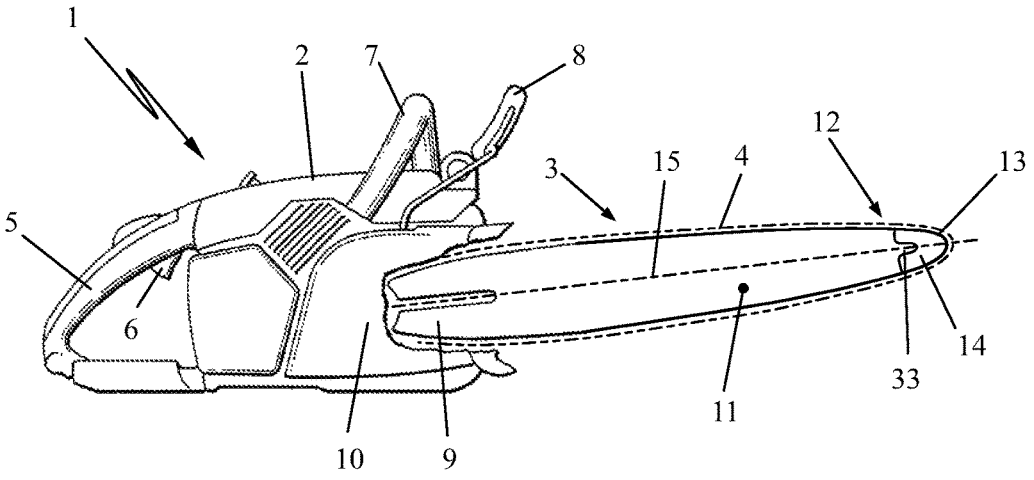
FIG. 1 is a schematic side view of a motor-driven chain saw.

FIG. 1 schematically illustrates a motor-driven chain saw 1. Arranged in the housing 2 is a drive motor for driving a saw chain 4 that runs around a guide bar 3. The drive motor can be a combustion engine, an electric motor, a compressed air motor or similar motor. In the rear housing region, the motor-driven chain saw 1 has a rear handle 5, extending in the longitudinal direction of the housing 2. The handle 5 has operator-controlled elements 6. A bale handle 7 is provided in the front region of the housing 2. The bale handle straddles the housing 2 transversely to the longitudinal direction thereof. Arranged in front of the bale handle 7 is a hand guard 8 which, by pivoting, triggers a safety braking unit (not illustrated in more detail).

The guide bar 3 extends from the front region of the housing 2 in the longitudinal direction of the motor-driven chain saw 1; at the rear clamping end 9 of the guide bar 3. The guide bar is secured in a clamped manner between a sprocket wheel cover 10 and the housing 2.

In the exemplary embodiment shown, the guide bar 3 includes an elongate, flat base body 11. A direction-reversing section 13 for the saw chain 4 is formed at that end 12 of the base body 11 that is opposite the clamping end 9. The direction-reversing section 13 comprises an add-on component 14 which (at least in the region of its outer periphery, which forms a running surface 17 (FIG. 2) for the saw chain) is formed from a more wear-resistant material than the base body material of the base body 11.

The base body 11 extends along a longitudinal center axis 15 in the longitudinal direction of the motor-driven chain saw 1. A running surface 17 is formed on the outer periphery 16 (FIG. 2) of the base body 11. A guide groove 18, which has a groove base 19 (FIG. 6, FIG. 10), is furthermore provided centrally in the outer periphery 16. The running surface 17 extends on both sides of the guide groove 18.

Figure 5:
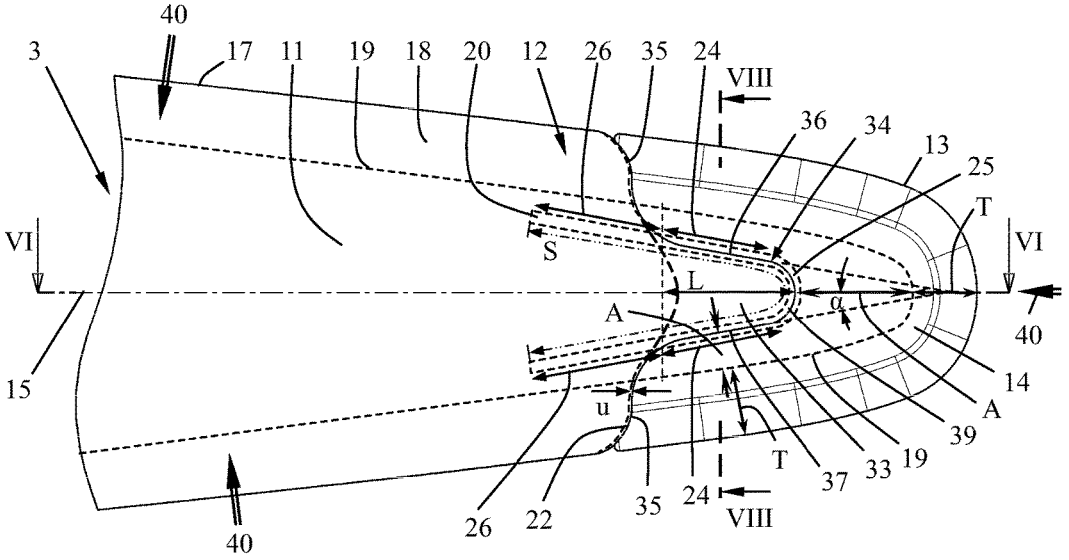
FIG. 5 is an enlarged view of the detail V in FIG. 3.
Figure 9:
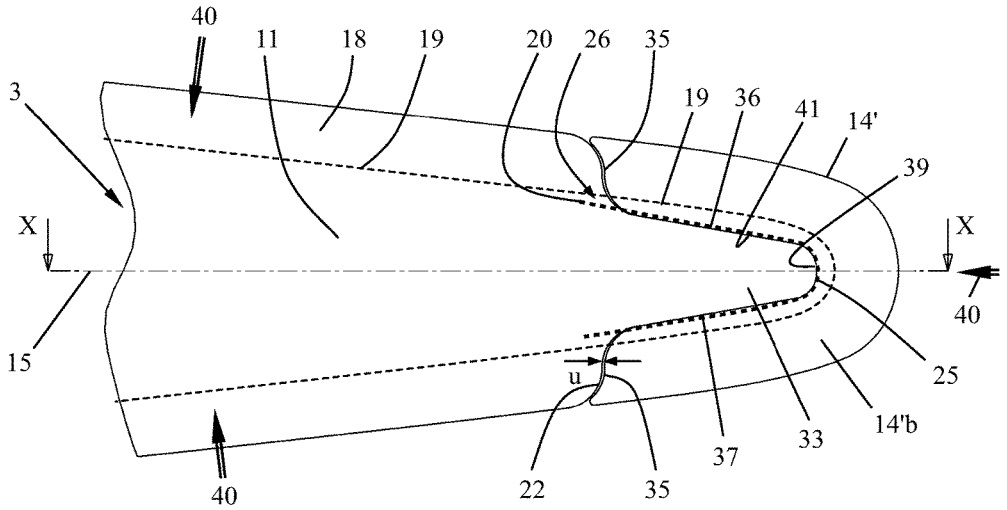
FIG. 9 is a partial view of a further embodiment of the direction-reversing section of a guide bar having an add-on component.

The add-on component 14, which forms the direction-reversing section 13 at the front end 12 of the guide bar 3, is firmly connected to the base body 11 by at least one weld seam 20 (FIG. 5, FIG. 9), wherein (as FIGS. 5 and 9 show) the weld seam 20 extends between the add-on component 14 and the base body 11 of the guide bar 3, and is thus located at the front end 12 of the guide bar 3. Along a major part of its length S, the weld seam 20 extends spatially between the longitudinal center axis 15 of the guide bar 3 and the groove base 19 (FIGS. 5 and 9) of the guide groove 18. The weld seam 20 between the add-on component 14 and the base body 11 is thus located (perpendicularly to the open guide groove 18 or the groove base 19 in the viewing direction 40) beneath the groove base 19.

Figure 6:
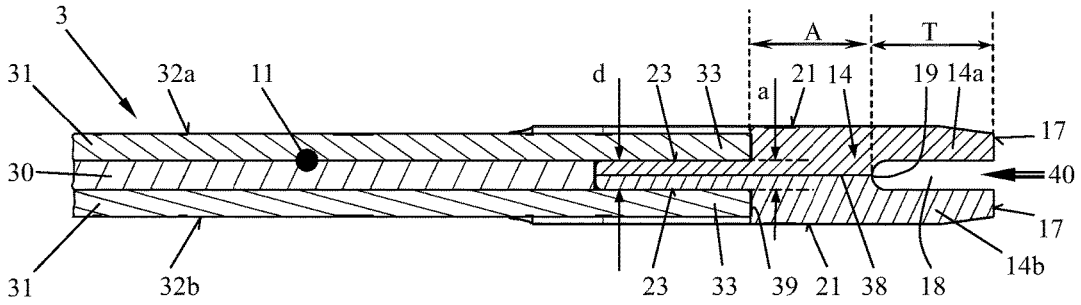
FIG. 6 is a section view taken along line VI-VI in FIG. 5.
Figure 7:
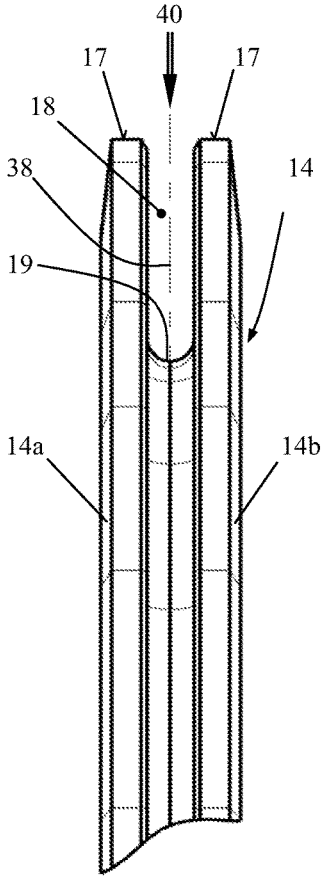
FIG. 7 is an enlarged partial view of the add-on component made of more wear-resistant material.
Figure 10:
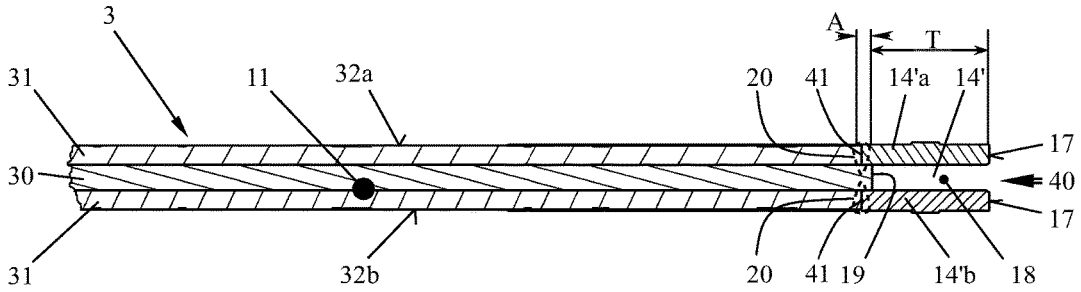
FIG. 10 is a section view taken along line X-X in FIG. 9.

As is illustrated schematically and in a greatly enlarged manner in FIGS. 5, 6 and 10, the weld seam 20 is located at a distance A from the groove base 19 of the guide groove 18 of preferably less than about twice the depth T of the guide groove 18, in particular less than half the depth T of the guide groove 18. The weld seam 20 is thus at a distance, measured in the plane of the guide bar 3, from the running surface 17 of the guide bar 3 of less than about three times the depth T of the guide groove 18, in particular less than twice the depth T of the guide groove 18; the distance of the weld seam 20 from the running surface 17 corresponds to the sum of the distances A plus T. In particular, the distance A of the weld seam 20 from the groove base 19 is in the range between 0.3 mm and 10 mm, preferably in a range from 0.5 mm to 5 mm, in particular about 0.77 mm. The depth T, measured from the running surface 17 to the groove base 19, of the guide groove 18 is in the range between 2 mm and 20 mm, preferably between 3 mm and 10 mm, in particular 5.05 mm.

Figure 2:
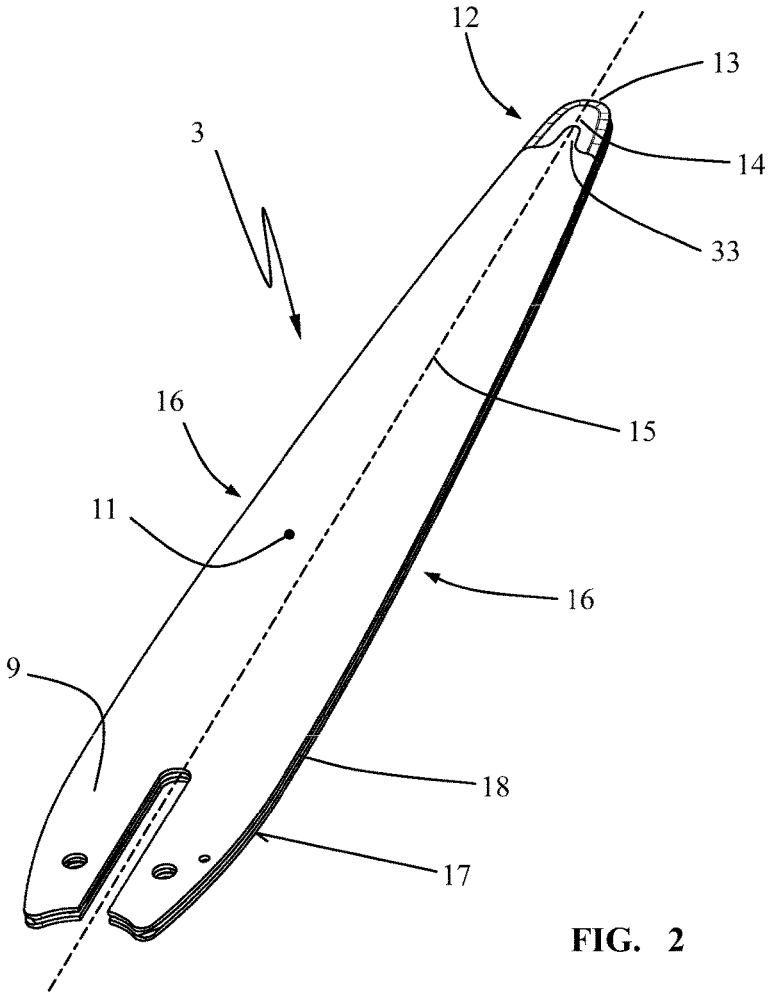
FIG. 2 is a perspective view of a guide bar for a motor-driven chain saw according to FIG. 1.
Figure 3:
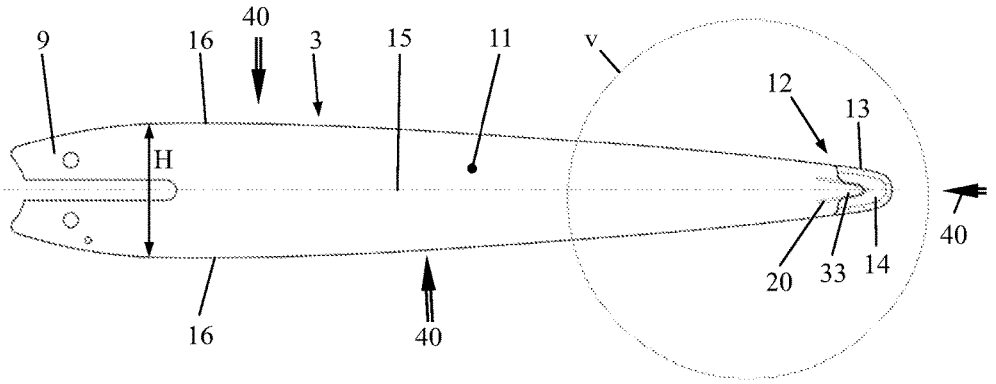
FIG. 3 is a side view of the guide bar according to FIG. 2.
Figure 4:
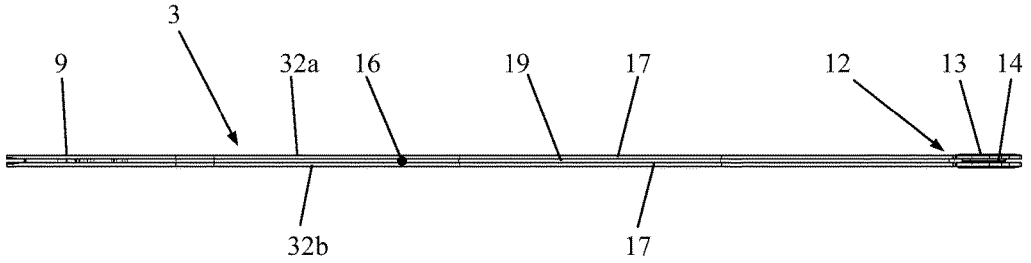
FIG. 4 is a plan view of the outer periphery of a longitudinal edge of the guide bar according to FIG. 3.

As FIGS. 2 and 3 show, the guide bar has, in the region of the clamping end 9, a greatest height H, measured transversely to the longitudinal center axis 15, that decreases continuously as far as the direction-reversing section 13 at the free end 12. Such a guide bar is also known as a carving bar.

In the exemplary embodiment according to FIGS. 3 to 8, the add-on component 14 comprises two add-on component halves (14*a*, 14*b*) (FIG. 6), wherein the add-on component halves (14*a*, 14*b*) are preferably identical parts, that is, are formed in an identical manner.

As can be seen in particular from FIG. 6, the guide groove 18 of the base body 11 continues in the add-on component 14. FIG. 6 shows that not only the guide groove 18 but furthermore also the groove base 19 of the guide groove 18 is formed in the add-on component 14.

In the exemplary embodiment shown, the guide bar 3 is a built-up guide bar 3; its base body 11 comprises a center plate 30 which is covered by side plates 31. The outer sides of the side plates 31 furthermore form flat sides 32*a* and 32*b* of the base body 11 of the guide bar 3. One side plate 31 forms the first flat side 32*a* and the other side plate 31 forms the second flat side 32*b*. Alternatively, the guide bar 3 can also be formed from a solid material.

Each side plate 31 has a finger-like extension in the form of a projection 33, wherein the projection 33, which is formed in a substantially flat manner, extends in the direction of the longitudinal center axis 15 and forms the end 12 of the base body 11. In the direction of the longitudinal center axis 15, the projection 33 engages in the add-on component 14 in order to fix the latter in its position on the base body 11. In this case, provision is made for the projection 33 to be held in an approximately play-free manner in the add-on component 14, while the abutment edges 35 located in the root region of the projection 33 have slight play (u) with respect to the edge 22 of the add-on component 14. This avoids static redundancy of the support of the add-on component 14 on the projection 33.

In the exemplary embodiment according to FIGS. 2 to 8, the projection 33 of the base body 11 of the guide bar 3 engages over the add-on component 14; in other words, the projections 33 overlap the add-on component 14. In this case, provision is made for the weld seam 20 to be positioned such that it delimits the overlap region 34.

Figure 8:
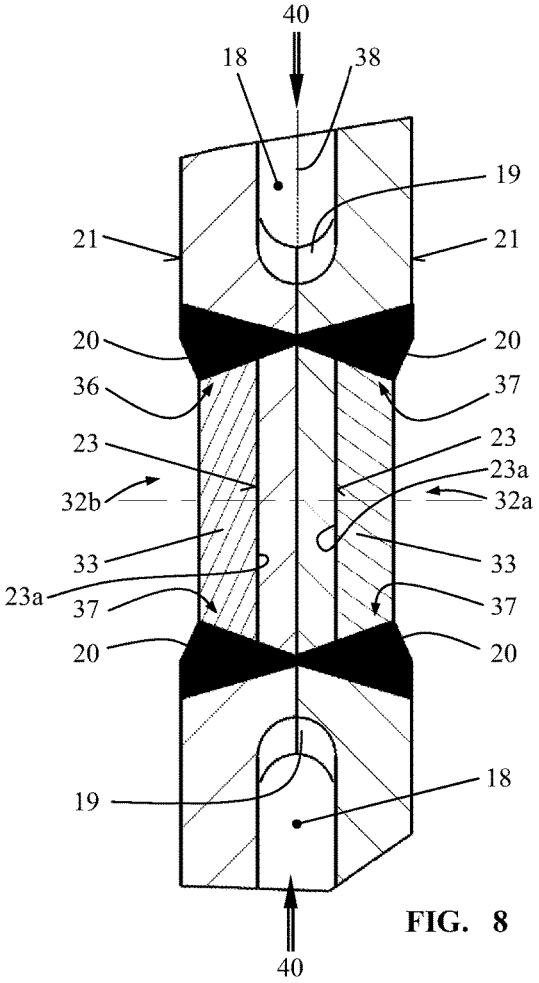
FIG. 8 is a section view taken along line VIII-VIII in FIG. 5.

The add-on component 14 is fixed in its position at the front end of the base body 11 preferably in a form-fitting manner, for which purpose it interacts in a suitable manner with the projections 33. Thus, a projection that extends in the direction of the longitudinal center axis 15 can be formed on the base body 11 of the guide bar 3 on each flat side (32*a*, 32*b*) in the region of the direction-reversing section 13, the projection 33 being received in a recessed region 23 of the add-on component 14. The recessed region 23 is formed in the outer side 21 of an add-on component 14*a* or 14*b* and receives the projection 33 substantially along its entire length that extends in the direction of the longitudinal center axis 15. Preferably, a projection 33 is received in the recessed region 23 largely without play to lie in contact engagement with support surface 23*a* as shown in FIG. 8. The recessed region 23 is advantageously deeper than the material thickness of the projection 33. The depth of the recessed region 23 is selected such that the outer side 21 of the add-on component 14 is located approximately in the same plane as the flat side 32*a* or 32*b* of the guide bar 3.

In the exemplary embodiment, the add-on component is composed of two add-on component halves 14*a* and 14*b* which rest against one another in a partition plane 38; the projections 33 are in this case each located in a recessed region 23 of one add-on component half 14*a* and 14*b*, such that the add-on component halves 14*a* and 14*b* of the add-on component 14 are held between the projections 33. Preferably, the add-on component halves 14*a* and 14*b* of the add-on component 14 are dimensioned such that the material that remains in the region of the recessed regions 23 has a thickness (d) which corresponds approximately to the distance (a) between the projections 33 of the two side plates 31. Preferably, the thickness (d) is formed with a slight excess thickness such that the add-on component 14 composed of the add-on component halves 14*a* and 14*b* is held in a clamped manner between the projections 33. This can be advantageous in the preassembly of the guide bar.

Once the add-on component halves (14*a*, 14*b*) of the add-on component 14 have been plugged onto the end 12 of the base body 11 of the guide rail 3, the add-on component 14 is fixed preferably by means of welding. Laser welding is particularly suitable for this purpose, wherein the weld seam 20 is configured such that it extends along the contour of the projection 33. The weld seam extends advantageously along a segment 24 of its length S along the longitudinal edges 36 and 37 of the projection 33. As illustrated in FIG. 5, the weld seam 20 extends along the two longitudinal edges 36 and 37 of the projection 33, wherein the segments 24 of the weld seam 20 are connected together at the longitudinal edges via an arc segment 25 of the weld seam 20. The arc segment 25 of the weld seam 20 corresponds to the shape of the free end of the projection 33. As FIG. 5 shows, the weld seam 20 extends over the entire edge of the projection 33. The edge of the projection 33 is formed by the longitudinal edges 36 and 37 and the arc segment 39, connecting the longitudinal edges 36 and 37, of the free end of the projection 33.

As FIG. 5 shows, the weld seam 20 continues over a run-out segment 26 in the base body 11 of the guide bar 3. The length of the run-out segment 26 corresponds approximately to the length L, measured in the direction of the longitudinal center axis 15, of the projection 33.

As can be seen from FIGS. 6 and 8, the projections engage on both flat sides (32*a*, 32*b*) of the base body 11 of the guide bar 3 into in each case one add-on component half (14*a*, 14*b*) of the add-on component 14 and fix the latter in position on the base body 11. The weld seam 20 is executed on each of the flat sides 32*a* and 32*b* of the guide bar 3, as the sectional illustration in FIG. 8 shows. In this case, a weld seam 20 passes to such a depth that the weld seam 20 on the one, first flat side 32*a* and the weld seam 20 on the other, second flat side 32*b* merge into one another or come into contact with one another in the region of the partition plane 38 of the add-on component 14. As a result, not only is each add-on component half (14*a*, 14*b*) of the add-on component 14 firmly connected to the respective side plate 31 of the base body 11, but the add-on component halves (14*a*, 14*b*) are also connected together cohesively in the region of their partition plane 38.

In the exemplary embodiment according to FIGS. 9 and 10, the add-on component 14' consists of two add-on component halves 14'*a* and 14'*b* which are each connected individually to a side plate 31. An add-on component half 14'*a* or 14'*b* rests with its inner edge 41 against the longitudinal edges 36 and 37 and against the arc segment 39, connecting the longitudinal edges together, of the free end of the projection 33, preferably without play. The abutment edge 35 of the add-on component has in this case—as also illustrated in FIG. 5—slight play (u) with respect to the edge 22 of the base body 11 of the guide bar 3, the edge extending on both sides of the projection 33 in the root region of the projection. As a result of the play (u), static redundancy of the add-on component 14' on the base body 11 of the guide bar 3 is avoided.

Figure 11:
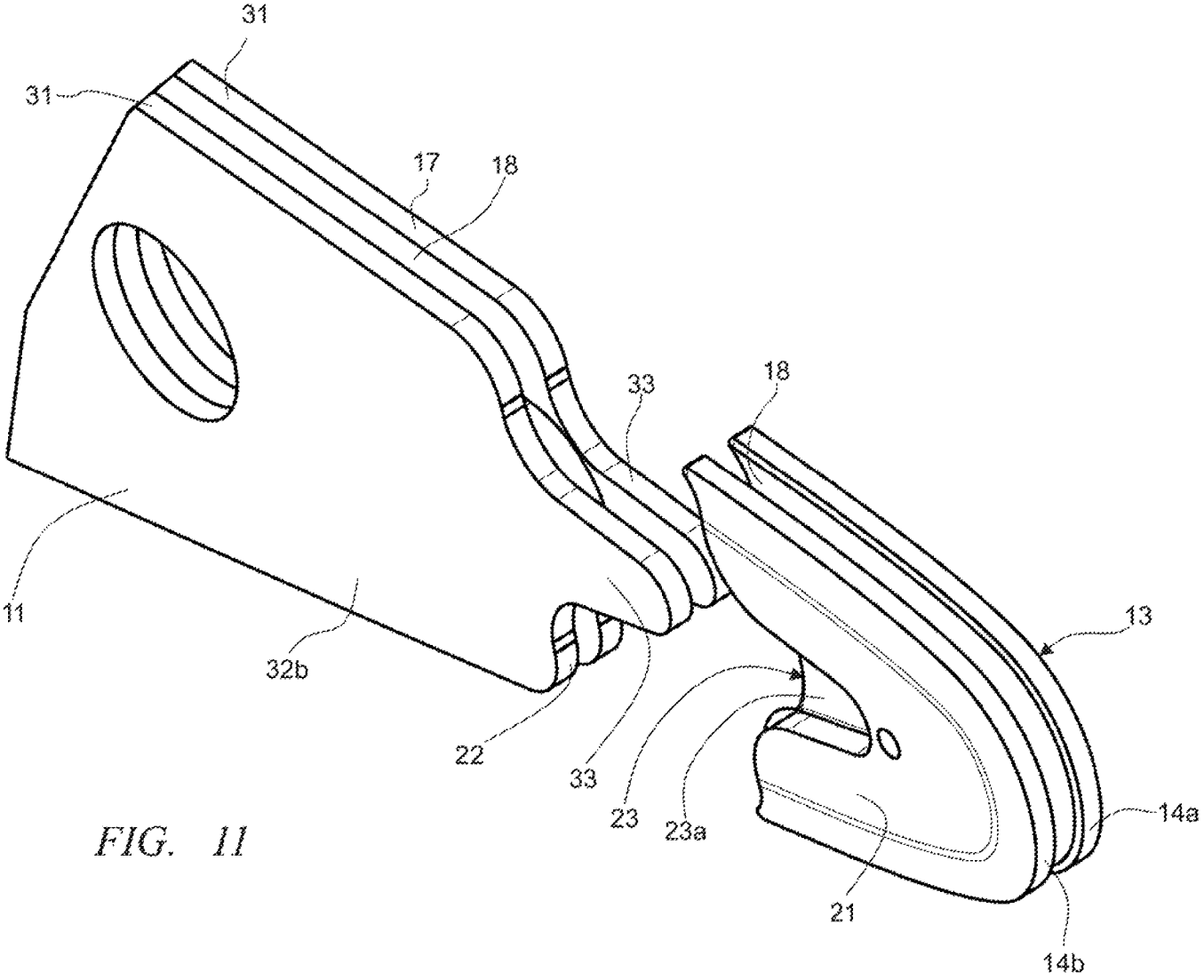
FIG. 11 shows a perspective view of a guide bar before the add-on component is attached to the base body.
Figure 12:
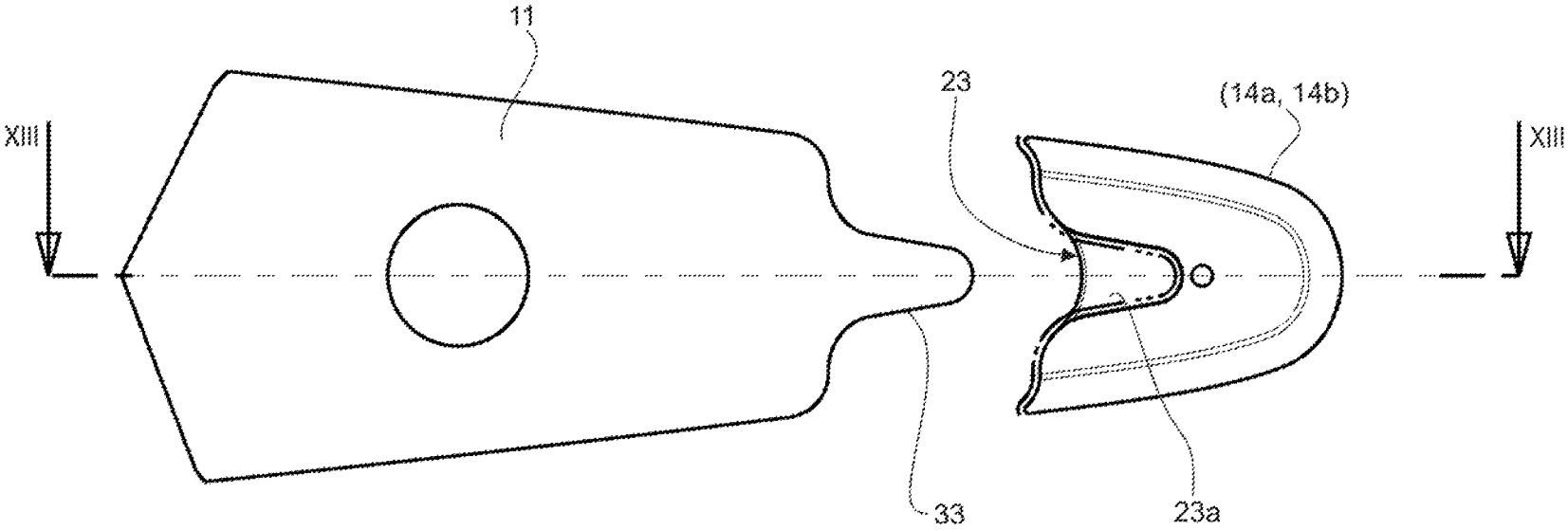
FIG. 12 shows a side elevation view corresponding to the perspective view of FIG. 11; and, FIG. 13 is a section view taken along line XIII-XIII of FIG. 12.
Figure 13:
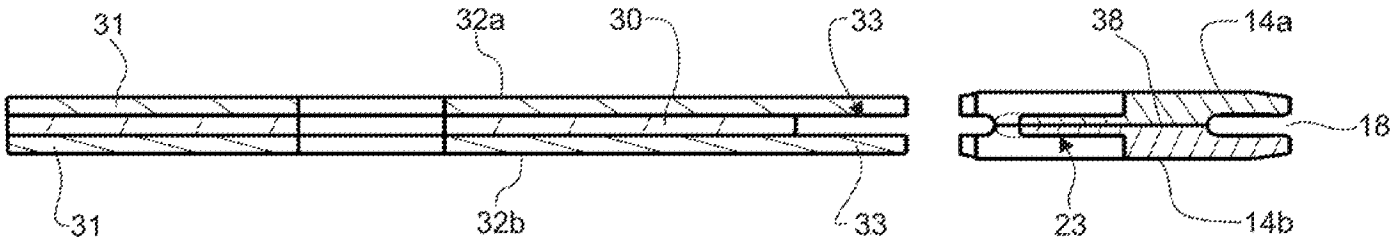

FIG. 11 shows a perspective view of the guide bar before the add-on component (14*a*, 14*b*) is welded to the base body 11. FIG. 12 shows a side elevation view corresponding to the perspective view of FIG. 11 and FIG. 13 is a section view taken along line XIII-XIII of FIG. 12.

As FIG. 10 shows, in the exemplary embodiment according to FIGS. 9 and 10, the center plate 30 projects in between the add-on component halves 14'*a* and 14'*b* of the add-on component 14'. The edge 41 of an add-on component half 14'*a* and 14'*b* is thus located lower than the groove base 19 perpendicularly to the groove base 19 of the guide groove 18 in the viewing direction 40.

The weld seam 20 is guided along the longitudinal edges 36 and 37 and along the arc segment 39, connecting the longitudinal edges, of the projection 33, wherein the run-out segments 26 of the weld seam 20 extend, in continuation of the longitudinal edges 36 and 37, into the base body 11 of the guide bar.

Since the center plate 30 projects in between the add-on component halves 14'*a* and 14'*b*, the groove base 19 is located higher—in the viewing direction 40 onto the groove—than the edge 41 of the add-on component; the weld seam 20 is thus located beneath the groove base 19.

The weld seam 20 extends in the region between the edge 41 of the add-on component 14' and the side plates 31 of the base body 11 of the guide bar 3 and is thus located, along a majority of its length—in the exemplary embodiment along its entire length—beneath the groove base 19 in the add-on component 14'; in other words, the weld seam 20 is located, as seen in the—preferably perpendicular—viewing direction 40 onto the groove base 19, beneath the groove base 19. The weld seams 20 executed on both flat sides 32*a* and 32*b* of the guide bar 3 in order to secure the add-on component halves 14'*a* and 14'*b* of the add-on component 14' are expediently produced by laser welding; the depth of the weld seam 20 can preferably be set such that the weld seams 20 applied to the opposite flat sides 32*a* and 32*b* of the guide bar 3 come into contact and/or are connected cohesively together at the depth.

The add-on component 14 or 14', or the add-on component halves (14*a*, 14*b*, 14'*a*, 14'*b*) of an add-on component (14, 14'), preferably consist of a sintered material, expediently of Stellite. A material known under the designation Stellite 12, which is based on a cobalt-base alloy with 29 percent by weight of chromium, 8 percent by weight of tungsten and 1.3 percent by weight of carbon, can be used as Stellite.

The add-on component or its add-on component halves can also consist of different materials, it being essential that at least the running surface for the saw chain is formed from a wear-resistant material such as Stellite or the like.

In the exemplary embodiments shown, the weld seam 20 is shown as a continuous weld seam; it may be expedient, rather than a continuous weld seam, to provide welding spots which are located in a row one after the other and form a dotted weld seam.

In the exemplary embodiments shown, the projection 33 extending as an extension in the direction of the longitudinal center axis 15 is formed such that—starting in the root region of the projection—it forms two longitudinal edges 36 and 37 which are substantially straight and run toward one another (FIG. 5). A longitudinal edge (36, 37) of a projection 33 forms, in continuation, an angle $\alpha$ of about 5° to 15°, in particular 10°, with the longitudinal center axis 15. The continuations of the two longitudinal edges 36 and 37 thus enclose an angle of about 10° to 30°, in particular an angle of 20°. The two longitudinal edges 36 and 37 are connected together via an arc segment 39 of the free end of the projection 33. The arc segment 39 is a circular arc segment with a circumferential angle of less than 180°, in particular 160°.

It is understood that the foregoing description is that of the preferred embodiments of the invention and that various changes and modifications may be made thereto without departing from the spirit and scope of the invention as defined in the appended claims.

What is claimed is:

1. A guide bar for a saw chain, the guide bar defining a plane and a longitudinal center axis and comprising:

an elongated, flat base body extending along said longitudinal center axis and having first and second outer flat sides;

said base body having an outer periphery and having a guide track formed on said outer periphery for the saw chain;

said guide track including a running surface and a guide groove having a groove base;

a direction-reversing section for the saw chain configured on one end of said base body;

said direction-reversing section being configured as an add-on component;

said running surface, said guide groove of said base body and said groove base being continued in said add-on component so as to cause said running surface and said guide groove together with said groove base to continue in said add-on component;

said base body being made of a first material and said add-on component being made of a second material having a wear resistance greater than said first material;

said first and second flat sides having respective projections formed thereon in the region of said add-on component;

said projections being configured to extend in the direction of said longitudinal center axis and overlap said add-on component;

said add-on component having respective outer surfaces formed as support surfaces parallel to corresponding ones of said first and second flat sides of said base body and positioned in between said projections;

said projections being in contact engagement with corresponding ones of said support surfaces so as to hold said add-on component therebetween;

said add-on component being fixed to said base body by a first weld seam on an edge of said first outer flat side of said base body and a second weld seam on an edge of said second outer flat side of said base body;

said first and second weld seams running between said add-on component and said base body and lying over their respective lengths (S) spatially below said groove base of the guide bar; and, at least one of said weld seams extending in depth perpendicularly to said first and second flat sides so as to cause one of said support surfaces of said add-on component to be welded with a corresponding one of said projections.

2. The guide bar of claim 1, wherein said base body and said add-on component conjointly define an overlapping region whereat said base body overlaps said add-on component and the corresponding weld seam is configured to delimit said overlapping region.

3. The guide bar of claim 1, wherein said add-on component has a position on said base body and is fixed form tight on said base body in said position.

4. The guide bar of claim 3, wherein said projections are configured to fix said add-on component in said position thereof on said base body.

5. The guide bar of claim 4, wherein at least one of said projections has a longitudinal edge; and, said weld seam extends along said longitudinal edge of said one projection over a segment of said length (S) thereof.

6. The guide bar of claim 1, wherein said add-on component has respective recessed regions for receiving corresponding ones of said projections thereon.

7. The guide bar of claim 6, wherein said projections are received in respective ones of said recessed regions without play.

8. The guide bar of claim 6, wherein said projections conjointly define a gap (a) therebetween and said add-on component has a thickness at said recessed regions thereof which is greater than said gap (a) so as to permit said add-on component to be clampingly held between said projections.

9. The guide bar of claim 1, wherein said wear resistant material of said add-on component is a sintered material.

10. The guide bar of claim 9, wherein said wear resistant material of said add-on component is a stellite.

11. The guide bar of claim 1, wherein said add-on component comprises two add-on component halves placed together to define said add-on component.

12. The guide bar of claim 11, wherein said two add-on component halves are identical parts.

13. The guide bar of claim 11, wherein said add-on component defines a partition plane; and, said first and second weld seams merge with each other at said partition plane.

14. The guide bar of claim 1, wherein each of said projections has a longitudinal edge which extends along said groove base.

15. The guide bar of claim 1, wherein each one of said weld seams lies spatially below said groove base in the longitudinal direction of said guide track over the entire length (S) of the weld seam; said one weld seam is at a distance (A) from said groove base measured in the plane of said guide bar; and, said distance (A) is less than three times the depth (T) of said guide groove.

16. The guide bar of claim 15, wherein said distance (A) is less than two times the depth (T) of said guide groove.

17. The guide bar of claim 1, wherein each one of said weld seams follows the course of said guide track so as to cause the distance between the weld seam and guide track at the tip of said guide bar to be at most twice as great as the distance between the weld seam and the guide track at the butt edge of the add-on component to the base body of said guide bar.

18. The guide bar of claim 17, wherein segments of each one of said weld seams are connected to each other via an arcuate segment of the weld seam; and, said arcuate segment has a maximum spacing to said guide track which is less than twice the depth (T) of said guide groove.

19. The guide bar of claim 17, wherein the distance of the weld seam to the guide track measured perpendicularly to the tip of the guide bar is less than thrice the depth (T) of said guide groove.

20. The guide bar of claim 1, wherein each of said weld seams, viewed in a direction toward said groove base, is arranged below said groove base so as to cause material stress in the region of said guide groove to be reduced.

21. The guide bar of claim 1, wherein said direction-reversing section is configured without a direction-reversing sprocket wheel.

22. The guide bar of claim 1, wherein each one of said weld seams extends in depth in the region of said add-on component to between said projections so as to cause a first one of said weld seams on said first outer flat side and a second one of said weld seams on said second outer flat side to touch each other.

* * * * *